US006862828B1

(12) United States Patent
Joyce

(10) Patent No.: US 6,862,828 B1
(45) Date of Patent: Mar. 8, 2005

(54) APPARATUS FOR CONVERSION OF BREECH-LOADING FIREARMS INTO MUZZLE-LOADING FIREARMS

(76) Inventor: Roger Dale Joyce, 708 Dowell Dr., Princeton, KY (US) 42445

( * ) Notice: Subject to any disclaimer, the term of this patent is extended or adjusted under 35 U.S.C. 154(b) by 0 days.

(21) Appl. No.: 10/832,571

(22) Filed: Apr. 27, 2004

(51) Int. Cl.[7] ..... F41C 7/00
(52) U.S. Cl. ..... 42/51; 42/83; 42/90
(58) Field of Search ..... 42/51, 83, 77, 42/90; 89/1.3

(56) References Cited

U.S. PATENT DOCUMENTS

| | | | | | |
|---|---|---|---|---|---|
| 173,476 | A | | 2/1876 | Ladd | |
| 3,780,464 | A | | 12/1973 | Anderson | |
| 4,222,191 | A | | 9/1980 | Lee et al. | |
| 4,232,468 | A | | 11/1980 | Chapin | |
| 4,437,249 | A | | 3/1984 | Brown et al. | |
| 4,715,139 | A | * | 12/1987 | Rodney, Jr. | 42/51 |
| 5,010,677 | A | | 4/1991 | Carron | |
| 5,487,232 | A | * | 1/1996 | Osborne et al. | 42/51 |
| 5,642,583 | A | | 7/1997 | Ball et al. | |
| 5,755,053 | A | * | 5/1998 | Oakley | 42/51 |
| 5,806,227 | A | * | 9/1998 | Yoder | 42/90 |
| 6,176,031 | B1 | * | 1/2001 | Ramsey | 42/90 |
| 6,516,549 | B1 | | 2/2003 | Hildebrandt et al. | |
| 6,718,677 | B2 | * | 4/2004 | Camp | 42/51 |
| 2002/0035800 | A1 | | 3/2002 | Lewis | |
| 2002/0129534 | A1 | * | 9/2002 | Hengstenberg | 42/83 |

* cited by examiner

*Primary Examiner*—J. Woodrow Eldred
(74) *Attorney, Agent, or Firm*—Greenbaum Doll & McDonald PLLC; James C. Eaves, Jr.

(57) ABSTRACT

The present invention is a system for converting a conventional modern firearm into a muzzle-loading firearm capable of utilizing modern rifle propellants. The invention utilizes a breech plug disposed in the breech end of a firearm to accept a rifle primer and powder charge, and a primer installation tool to accurately and securely seat a rifle primer in a primer pocket.

11 Claims, 4 Drawing Sheets

APPARATUS FOR CONVERSION OF BREECH-LOADING FIREARMS INTO MUZZLE-LOADING FIREARMS

BACKGROUND OF THE INVENTION (a) Field of the Invention

The present invention relates generally to muzzle-loading firearms and more specifically to a system and method for converting a conventional breech-loading firearm into a muzzle-loading firearm. The present invention features a primer insertion tool to seat a primer in a primer pocket tightly enough to allow the use of conventional rifle primers.

(b) Description of the Prior Art

In recent years, hunting and sport shooting enthusiasts have witnessed a proliferation of the use of muzzle-loading firearms, caused in large part by the advent of special "muzzle-loading weapons only" hunting seasons set aside by many states for certain species of game. As a direct result of the increased availability and use of muzzle-loading weapons, many hunters and target shooters have sought to increase the range and enhance the accuracy of these weapons.

Conventional modern muzzle-loading rifles and other muzzle-loading firearms typically include a barrel having an axial bore therein, a muzzle end into which a powder charge, wadding, and shot or ball are loaded, and typically a closed breech end into which the powder, wadding, and shot are pressed. Often the breech end includes a flame bore or passage from the breech end of the barrel to a nipple, onto which a percussion cap is fitted. A hammer is thence activated by depression of a trigger, striking the percussion cap and sending a flame through the flame bore to the powder charge in the breech end of the barrel, thus igniting the charge and forcing the shot or ball out of the muzzle-end of the barrel.

Modern breech-loading firearms also include a barrel having an axial bore but comprise a receiver (of varying types) at the breech end of the barrel which permits the insertion of a rifle cartridge or shotgun shell into the breech end of the barrel. The receiver is actuated to secure the cartridge or shell tightly in the breech end of the barrel. A firing pin, activated by a trigger mechanism, strikes a primer disposed in the cartridge, igniting the charge contained therein. Modern rifles utilize cartridges and receiver mechanisms for securing and sealing the cartridges in the rifle breech that permit the use of medium to slow-burning propellant powder charges to generate tremendous gas pressures over time, thereby allowing for high projectile muzzle velocities and great accuracy at distance. Ignition of these slower burning powders must be initiated by a rifle primer, or the equivalent.

In comparison with modern rifles, muzzle-loading firearms suffer from several disadvantages. Initially, they require no small amount of time to load, and greater skill to fire accurately due to the lower muzzle velocities typically generated. Furthermore, misfires and hang-fires (delayed firing caused by slow powder ignition) are relatively common occurrences with muzzle-loading rifles, which are particularly temperamental in inclement weather due to the absorption of moisture by the powder charge. Finally, muzzle-loaders must be thoroughly cleaned after each day in the field to prevent corrosion of the barrel and clogging of the flame bore.

Many inventions have attempted to overcome the various drawbacks of the aforementioned muzzle-loading firearms.

A variety of systems to modify a breech-loading firearm to produce a muzzle-loading firearm have been implemented. For example, U.S. Pat. No. 4,437,249 to Brown et al., incorporated herein by reference, discloses a steel breech plug adapted to be inserted into the breech end of a single barrel shotgun and includes a primer receiving bore for receiving a shotgun primer. This removable plug utilizes an o-ring to seal the plug in the breech of the shotgun barrel. Furthermore, U.S. Pat. No. 4,222,191 to Lee et al. discloses a conversion plug for use in a shotgun barrel, shaped like a shotgun shell for simple installation. The plug of this invention receives a nipple that is capable of accepting a percussion cap often used with black powder or black powder equivalent propellants.

Additionally, devices of the type disclosed by U.S. Pat. No. 6,516,549 to Hildebrandt et al. incorporate a breech plug including a primer receiving chamber and a primer carrier for inserting a shotgun primer into the primer receiving chamber. This invention utilizes a type of bolt action mechanism to initiate the motion of the primer carrier.

Finally, U.S. Patent Application Publication No. US2002/035800 to Lewis teaches a breech plug having a primer pocket for converting a black powder propellant muzzle-loading gun to a smokeless powder propellant muzzle-loading gun by utilizing a primer pocket that is designed to be used with a conventional 209 shotgun primer. This invention further discloses a primer extractor for removing the spent primer from the primer pocket.

One disadvantage with the prior art inventions described herein above is their inability to operate with the modern propellant powders that are commonly employed in a wide variety of rifle cartridges. The shotgun primers used in the prior art muzzle-loading weapons are simply unsuitable for consistent ignition of the slower-burning modern powders since they do not produce sufficient heat to ignite modern rifle propellants. Furthermore, use of modern rifle propellants causes greater pressure in the breech end of the barrel than black powder or black powder equivalent propellants. This is due to the fact that these propellants tend to burn very quickly, and consequently generate gas pressure very quickly. Because of the speed with which these propellants ignite they quickly build up to a gas pressure peak value for a given firearm, which should not be exceeded in the interests of safety.

In order to avoid excessive pressure, the size of the propellant charge used with black powder and black powder equivalents, typically denominated in grains, is much smaller than can be used with modern rifle propellants. Since the modern rifle propellants burn more slowly, a larger propellant load can be used to build up to and maintain a desired pressure level over time, which is nearly impossible to accomplish with the aforementioned black powder propellants.

When attempting to use modern rifle propellants with prior art muzzle-loading equipment, the gas pressure can cause "blowback" through the flame passage, forcing the spent primer from the primer pocket, causing hot gasses to escape from the receiver of the weapon. Furthermore, ignition of modern propellants is uncertain using percussion caps and shotgun primers.

SUMMARY OF THE INVENTION

The present invention obviates the aforementioned problems by providing a system for converting a conventional breech-loading firearm into a muzzle-loading firearm comprising a removable breech plug that is securely positioned in the breech end of a firearm barrel. The breech plug has a primer pocket that accepts a modern rifle primer, a powder chamber for modern rifle propellant, and a flash hole passage between the primer and powder pockets. A primer installation apparatus is provided for seating and securing the modern rifle primer in the primer pocket.

The present invention forces the rifle primer into the primer pocket with sufficient force to form a gas-tight seal against the pressure produced by the burning propellant, thereby permitting the use of slower burning, more efficient modern powders.

Therefore one object of the invention is an apparatus for converting a modern firearm into a muzzle-loading firearm.

A further object of the invention is a breech plug and primer insertion tool permitting the use of modern rifle primers and associated modern rifle propellants in a muzzle-loading rifle.

A further object of the invention is an insertion tool that seats a primer with sufficient force to prevent blow back gasses from escaping from the breech plug of the firearm during the discharge thereof.

Further objects and advantages of the present invention will be apparent from the detailed description of the preferred embodiments herein below in conjunction with the drawing figures.

DETAILED DESCRIPTION OF THE PREFERRED EMBODIMENT

Figure 1:
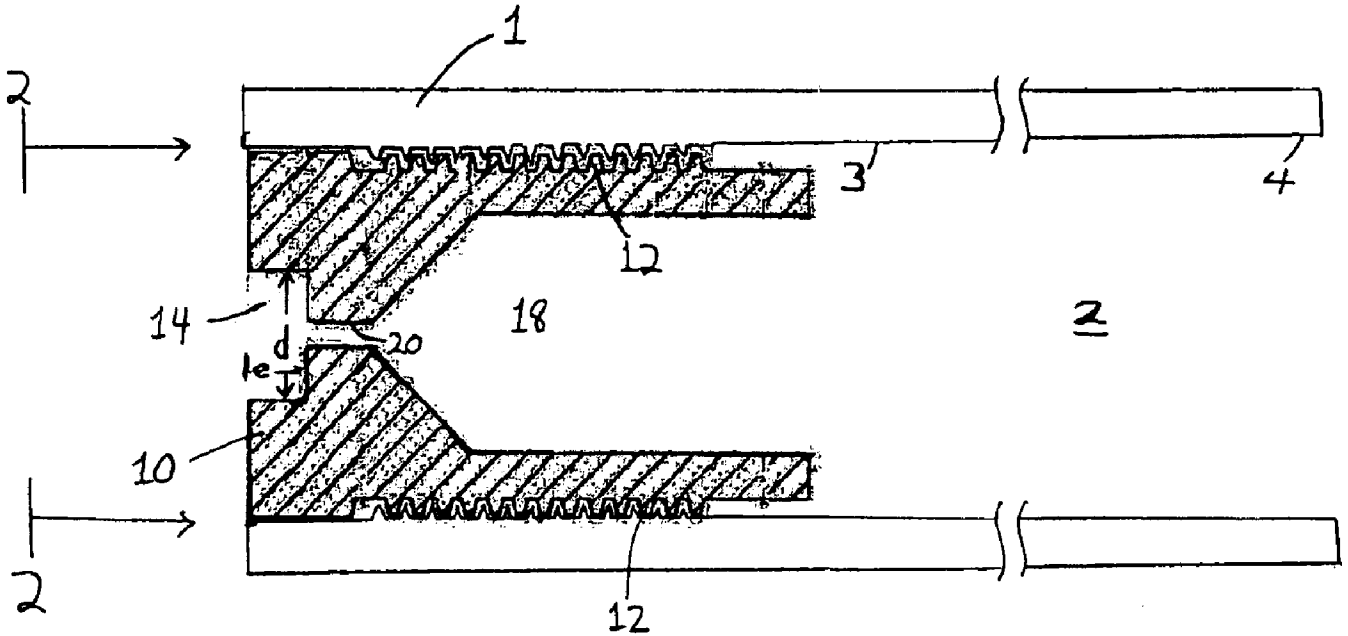
FIG. 1 is a cross-sectional view of a breech plug of the instant invention taken along the longitudinal axis.
Figure 2:
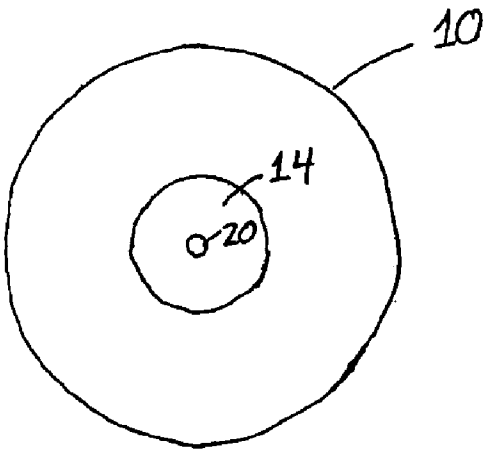
FIG. 2 is a view of a breech plug of the instant invention taken along the line 2—2 of FIG. 1.

Referring now to FIGS. 1 and 2, and in accordance with a constructed embodiment of the instant invention, a system for converting a conventional breech-loading firearm, for example a shot-gun, rifle or pistol, having a barrel 1 including a bore 2 therein, a breech end 3, and a muzzle end 4, into a muzzle-loading firearm comprises a breech plug 10 and a primer installation tool 30.

The breech plug 10 is generally cylindrical in shape and includes a plurality of threads 12 cut into a portion of the exterior circumferential surface of the plug 10 in order to secure the plug 10 in the breech end 3 of the barrel 1. In one embodiment of the present invention the inner circumference of the breech end 3 of the firearm barrel 1 is provided with a set of threads that are complementary to the threads 12 of the breech plug 10. The breech plug 10 is then securely threaded into the breech 3 of the barrel 1.

The breech plug 10 further comprises a generally cylindrical primer pocket 14 recessed in the breech end of the breech plug 10, sized to accept a suitable rifle primer as discussed further below. The primer pocket 14 dimensions may be varied depending on the particular firearm being converted. For example for a small rifle or pistol the pocket 14 diameter d will be in the range of 0.171–0.175 inches and the depth will be 0.119–0.125 inches, depending on the size of the firearm bore. Similarly, for large rifles or pistols the pocket 14 diameter will be in the range of 0.207–0.211 inches and its depth will be 0.120–0.135 inches. For large rifle bores, a primer pocket having a diameter d of 0.311–0.317 inches and a depth e of 0.219–0.230 inches will prove suitable. The primers suitable for use in conjunction with the present invention include but are not limited to large, small, and magnum rifle primers as used in many conventional modern firearms.

Of course, the dimensions given herein above for the primer pocket 14 are meant to be illustrative only, and do not limit the scope of the present invention. The breech plug 10 may utilize any primer pocket dimensions that are suitable for securely seating a modern rifle primer. Additionally, the overall diameter of the breech plug 10 may be sized to fit the breech end of the barrel 1 of the firearm being converted.

The breech plug 10 additionally comprises a powder chamber 18 into which a propellant charge is placed through the muzzle end 4 of the barrel 1. A flash passage 20 connects the powder chamber 18 and the primer pocket 14 to permit a flame to travel from the primer (when struck by a firing pin) to the powder chamber 18 to effect ignition of the powder charge therein.

The breech plug 10 may further comprise a plurality of shallow spaced holes 22 disposed in the breech end of the plug, that accept a plurality of spaced pins secured to an insertion tool (not shown). This feature of the instant invention simply facilitates the insertion and removal of the plug 10 from the barrel 1.

Figure 3:
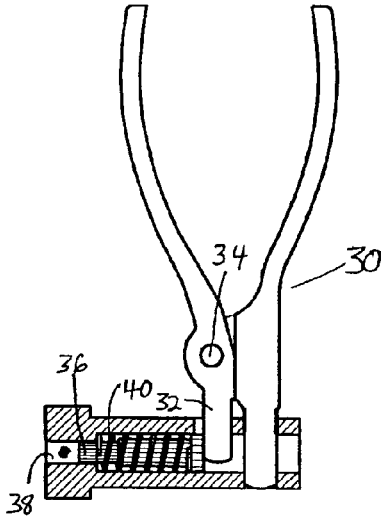
FIG. 3 is a diagram of a primer insertion tool in accordance with one embodiment of the present invention.

Referring now to FIG. 3, and in accordance with one embodiment of the instant invention, a primer installation tool 30 is depicted for inserting a rifle primer into the primer pocket 14. It is necessary to utilize a primer installation tool for the insertion of the rifle primer in the primer pocket 14 so that sufficient force is used in seating said primer into the primer pocket to effect a gas seal between the receiver of the firearm and the flash passage 20 and powder chamber 18 so that hot gasses created by the combustion of rifle propellants are not forced into the receiver of the weapon. The primer installation tool operates in an analogous fashion to a conventional reloading press, wherein a modern rifle primer is securely seated in a rifle cartridge. In one embodiment of the present invention, the rifle primer is seated securely enough to withstand 65,000 pounds per square inch (psi) of pressure to ensure that the hot propellant gasses do not escape from the breech end of the barrel 1.

In one embodiment of the present invention, the primer installation tool 30 of FIG. 3 utilizes an operator lever 32 that pivots about fulcrum 34 to push a primer pin 36 forward against a primer that is positioned in a chamber 38. The primer pin 36 is biased away from the chamber 38 by a conventional spring 40 to enable a primer to be inserted in the chamber.

Figure 6:
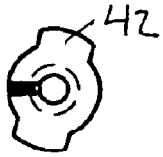
FIG. 6 is a view of the insertion head of FIG. 5 taken along the line 6—6.
Figure 5:
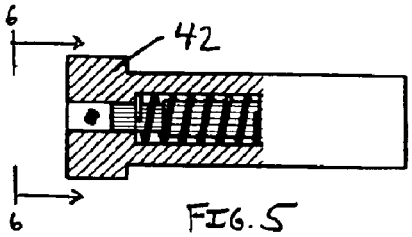
FIG. 5 shows a primer insertion head in accordance with one embodiment of the instant invention.
Figure 8:
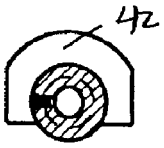
FIG. 8 is a view of the insertion head of FIG. 7 taken along the line 8—8.
Figure 7:
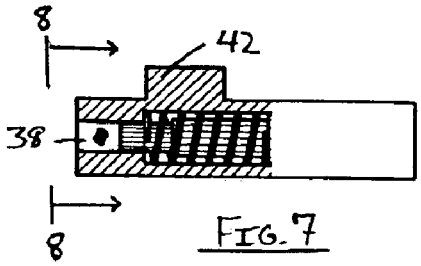
FIG. 7 shows a primer insertion head in accordance with one embodiment of the instant invention.
Figure 10:
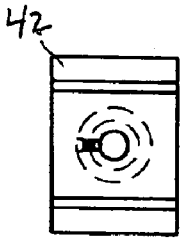
FIG. 10 is a view of the insertion head of FIG. 9 taken along the line 10—10.
Figure 9:
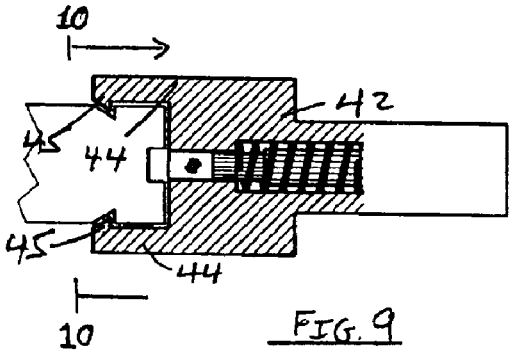
FIG. 9 shows a primer insertion head in accordance with one embodiment of the instant invention.

A head 42 of the installation tool, as best seen in FIGS. 5–10, is shaped to fit a specific firearm's receiver so that the head mates accurately with the breech plug 10. This feature of the present invention permits very accurate alignment of the primer and primer pocket 14, so that a tight seal is formed when the primer is forced into the primer pocket 14 by depression of lever 32 and the resultant motion of the primer pin 36. FIGS. 5 and 6 depict the shape of the installation tool head 42 suitable for use in most bolt-action firearms. FIGS. 7 and 8 depict an installation tool head 42 shaped to be used in a falling block type firearm. FIGS. 9 and 10 depict an installation tool head 42 having a pair of spaced legs 44 depending therefrom, each of said legs 44 having a tongue 45 shaped to engage a complementary groove in the barrel 1 of a break-open type firearm. Each of the aforementioned installation tool head designs operates to accurately align the chamber 38 with the primer pocket 14 so that the rifle primer is inserted into the primer pocket evenly around its circumference. Since the diameter of a rifle primer used for a given primer pocket 14 is actually slightly larger than the circumference of the primer pocket 14, it is necessary to accurately align the primer with the pocket 14 to prevent damage to the primer as it is pressed into place. While three specific installation tool heads 42 are shown in the drawing Figures, the installation tool 30 of the present invention may be readily modified to permit operation with most modern firearms by simply shaping the head 42 to accommodate the shape of the firearm receiver.

Figure 4:
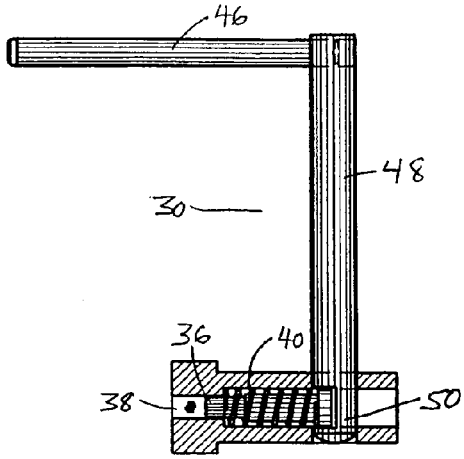
FIG. 4 is a diagram of a primer insertion tool in accordance with one embodiment of the present invention.

Referring to FIG. 4, an alternative installation tool 30 is shown employing a conventional cam action operator to seat the primer in the primer pocket 14. In this embodiment of the present invention, a lever 46 is used to rotate a shaft 48 having a notched end 50 that acts as a cam and engages the primer pin 36, thereby forcing it toward the primer pocket 14.

The foregoing detailed description is given primarily for clearness of understanding of the disclosed invention and no unnecessary limitations are to be understood or imputed therefrom, since modifications to the instant invention can be readily made by those skilled in the art upon reading this disclosure and may be made without departing from the scope of the invention disclosed herein and of the appended claims.

I claim:

1. A system for converting a breech-loading firearm having a barrel with a muzzle-end and a breech-end into a muzzle-loading firearm comprising:

a breech plug disposed in the breech-end of said firearm, having a primer pocket at a first end thereof for accepting a rifle primer, a powder chamber at a second end thereof, and a flash passage therebetween; and a primer installation tool having a sliding primer pin for inserting a rifle primer into the primer pocket of said breech plug.

2. The system as claimed in claim 1 wherein said breech plug is threadably secured in the breech of said barrel.

3. The system as claimed in claim 1 wherein said primer pocket is substantially cylindrical.

4. The system as claimed in claim 1 wherein said primer installation tool inserts said rifle primer into the primer pocket with a force sufficient to withstand up to 65,000 pounds per square inch of pressure.

5. The system as claimed in claim 1 wherein said rifle primer is a large rifle primer.

6. The system as claimed in claim 1 wherein said rifle primer is a magnum rifle primer.

7. The system as claimed in claim 1 wherein said rifle primer is a small rifle primer.

8. A system for converting a breech-loading firearm having receiver and a barrel with a muzzle-end and a breech-end into a muzzle-loading firearm comprising:

a breech plug threadably secured in the breech-end of said firearm, having a primer pocket at a first end thereof for securing a rifle primer, a powder chamber at a second end thereof, and a flash passage therebetween; and a primer installation tool having a head enclosing a sliding primer pin for inserting a rifle primer into the primer pocket of said breech plug, wherein said head is shaped to provide positive alignment of the rifle primer and the primer pocket of said breech plug.

9. A system as claimed in claim 8 wherein said primer installation tool head is shaped to operate with a bolt action receiver to provide positive alignment of the rifle primer and the primer pocket of said breech plug.

10. A system as claimed in claim 8 wherein said primer installation tool head is shaped to operate with a break open type receiver to provide positive alignment of the rifle primer and the primer pocket of said breech plug.

11. A system as claimed in claim 8 wherein said primer installation tool head is shaped to operate with a falling block receiver to provide positive alignment of the rifle primer and the primer pocket of said breech plug.

* * * * *